US007847665B2

(12) United States Patent
Zillmann et al.

(10) Patent No.: US 7,847,665 B2
(45) Date of Patent: Dec. 7, 2010

(54) METHOD FOR PRODUCING A TRANSFORMER COIL, AND A TRANSFORMER COIL PRODUCED USING THIS METHOD

(75) Inventors: Karl Zillmann, Marsberg (DE); Wolfgang Moenig, Brilon (DE); Benjamin Weber, Winterberg (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 12/520,359

(22) PCT Filed: Dec. 7, 2007

(86) PCT No.: PCT/EP2007/010650

§ 371 (c)(1),
(2), (4) Date: Jun. 19, 2009

(87) PCT Pub. No.: WO2008/074409

PCT Pub. Date: Jun. 26, 2008

(65) Prior Publication Data

US 2009/0309685 A1 Dec. 17, 2009

(30) Foreign Application Priority Data

Dec. 19, 2006 (DE) ..... 10 2006 060 567

(51) Int. Cl.
*H01F 27/30* (2006.01)
*H01F 27/28* (2006.01)

(52) U.S. Cl. ..... 336/182; 336/208; 336/222

(58) Field of Classification Search ..... 336/182, 336/222, 208, 198

See application file for complete search history.

(56) References Cited

U.S. PATENT DOCUMENTS

| | | | | |
|---|---|---|---|---|
| 4,518,941 | A * | 5/1985 | Harada | 336/69 |
| 5,374,810 | A * | 12/1994 | Gantt | 219/670 |
| 5,404,123 | A * | 4/1995 | Joseph | 336/192 |
| 5,861,791 | A * | 1/1999 | Schneider | 336/205 |
| 5,917,397 | A | 6/1999 | Sasahara et al. | |
| 6,404,316 | B1 * | 6/2002 | Busletta et al. | 336/198 |

(Continued)

FOREIGN PATENT DOCUMENTS

WO WO-2006069590 7/2006

OTHER PUBLICATIONS

International Search Report for PCT/EP2007/010650, mailed on Jun. 6, 2008.

*Primary Examiner*—Anh T Mai
(74) *Attorney, Agent, or Firm*—Leydig, Voit & Mayer, Ltd.

(57) ABSTRACT

A method for winding a coil for a transformer comprising providing a cylindrical inner tube of insulating material including a radially outwardly projected first end wall section disposed at a first end of the cylindrical inner tube and a radially outwardly projecting second wall section disposed at a second end of the cylindrical inner tube; winding a first insulating layer onto the cylindrical inner tube so as to extend to the first end wall section and the second end wall section; and winding a first winding wire layer onto the first insulating layer so as to provide a first distance between a first end of the first winding wire layer and the first wall section and a second distance between a second end of the first winding layer and the second end wall section.

11 Claims, 2 Drawing Sheets

U.S. PATENT DOCUMENTS 7,095,308 B2 8/2006 Kobayashi et al.
7,164,338 B2 * 1/2007 Odell et al. ..... 336/181

2004/0003492 A1 1/2004 Wu

* cited by examiner

METHOD FOR PRODUCING A TRANSFORMER COIL, AND A TRANSFORMER COIL PRODUCED USING THIS METHOD

This is a U.S. National Phase Application under 35 U.S.C. §171 of PCT/EP2007/010650, filed on Dec. 7, 2007, which claims priority to German Application No. DE 10 2006 060 567.5, filed Dec. 19, 2006. The International Application was published in German on Jun. 26, 2008 as WO 2008/074409 under PCT article 21 (2).

The invention relates to a method for winding a coil for a transformer.

BACKGROUND

A transformer coil has a coil tube, which is surrounded by a secondary winding and a primary winding, the latter of which is embedded in a block of insulating material, the windings being produced by the so-called filament winding method. For this purpose, a first insulating layer is wound onto the coil tube, which is separated from the secondary winding by means of spacers, and a first layer of the winding wire is wound onto said first insulating layer. A layer of insulating material is applied to this first wire layer, again a layer with winding wire is applied to this insulating layer, this wire layer comprising two layer sections, which extend inwardly, i.e. toward one another, from the two ends of the inner layer of the winding wire and end at a certain distance from one another. The opposite ends of the inner layer are connected to the adjacent ends of the second layer sections. In the case of known winding methods, it must be ensured here that the opposite ends of the second layer sections do not slip off outward over the inner first layer. This is achieved by the opposite winding ends of the second layer sections being at an axial distance from the winding ends of the inner layer, so that the connections of the adjacent winding ends each form an acute angle with the annular surface of the inner first layer; the two angles together form a V shape, the open side of which is open toward the inner first layer.

The mutually opposing ends of the second layer sections are each adjoined by a third layer section, with an intermediate layer of insulating material in turn being introduced between the second and third layer sections. The mutually opposing ends of the third layer sections end again at a distance from the adjacent ends of the second layer sections, so that the connections of the inner, mutually opposing ends of the second and third layer sections likewise together form an acute angle, with the two connections forming a V shape, the tip of which points radially inward. These three layer sections are followed, for example, by two fourth and fifth layer sections, the lengths of which are axially shortened with respect to the previously wound layers, so that here too the V shapes are formed.

These winding forms, i.e. the offset, have the result that the winding space available is not optimally and fully utilized.

SUMMARY OF THE INVENTION

An aspect of the present invention is to provide a method for producing a transformer coil and a transformer coil produced using this method, of the type mentioned at the beginning, in the case of which the winding space is better utilized.

In an embodiment, the present invention comprises a method which is characterized by the following steps:

winding an inner first insulating layer onto a cylindrical body of insulating material, at the ends of which radially outwardly projecting end wall sections are provided, with the insulating layer being wound as far as the end wall sections, winding on an inner first winding wire layer, the end windings of which are at a distance from the end wall sections, winding a second insulating layer onto the inner first winding wire layer as far as the end wall sections, winding on a second winding wire layer, which can be wound in one or two layer sections, the opposite end windings of the second winding wire layer or of the layer sections lying in the radial plane of the end windings of the inner first winding wire layer, connecting the adjacent ends of the first and second winding wire layers by means of radial connecting elements, winding on a third insulating layer as far as the end wall sections, winding on a third winding wire layer or two third layer sections, the end windings of which lie radially in the plane of the end windings of the second layer sections, connecting the end windings, each lying in a radial plane, of the third layer sections to the ends of the second layer sections, winding on a fourth insulating layer as far as the end wall sections, and so on, and if appropriate, removing the end wall sections after the curing of the insulating material.

There is the possibility of integrally forming the end wall sections onto the inner tube.

A further advantageous refinement may comprise the provision of metal L-shaped angle pieces for the formation of the end wall sections, of which pieces one leg respectively forms the actual end wall section and the other leg is respectively arranged parallel to the coil tube and wound into the individual insulating layers. These L-shaped angle pieces can then be readily removed after curing. The slit-like openings thereby created can be readily closed with insulating material, or else simply remain open.

In this case, there is the possibility of forming the angle pieces in such a way that the legs which form the end wall sections extend over the entire end face of the coil; there is, of course, also the possibility of arranging a number of L-shaped angle pieces at radial intervals, inner L-shaped angle pieces being wound in by an inner insulating layer and outer L-shaped angle pieces being wound in by the corresponding outer insulating layer. In a preferred way, the angle pieces are formed by the provision of arcuate tubes, which are provided at one end with slits which are bent up perpendicularly in relation to the accurate regions, so that the end wall sections are formed by the perpendicularly bent-up legs.

With the winding method according to the invention and, in particular, with the provision of end wall sections for guiding and maintaining the shape of the insulating windings or layers at the axial ends of the coil, the connection of the winding wire layers lying one over the other can take place by means of the radially extending connecting pieces, because slipping off, axially outward or else inward, of the end windings lying one over the other of the respectively outer winding wire layer is avoided on account of the end wall sections, and accordingly the windings to be connected lie radially one over the other. The outer form of the transformer coil consequently has radial end faces and, inside the insulation formed by the various insulating layers, the winding space is optimally utilized. This brings about a shorter coil length and the amount of insulating material is reduced. The leg length of the matching core can also be shortened, whereby the core weight is also reduced.

In one embodiment according to the present invention, in the coil former wire winding sections are provided, the winding ends of which that are connected to one another each lying in a radial plane, so that all the winding sections lie between two radial planes in which at the same time the winding ends belonging to one another and connected to one another also lie, with radially extending connecting pieces being provided. The end wall sections may be formed onto an insulating tube or coil tube surrounded by the coil former; there is also the possibility that L-shaped angle elements are provided, the legs of which extend perpendicularly to one another, one of the legs being securely held parallel to the winding sections by the insulating layers, whereas the other leg projects radially outward and serves for the formation of the end wall sections.

There is the possibility of forming the angle elements as arcuate angle elements, one of the legs forming an arcuate shape and the other legs being bent out perpendicularly thereto as lugs.

The legs for forming the end wall sections may in this case cover the entire end face; there is also the possibility that a number of angle elements are arranged at different radii, so that the legs forming the end wall sections only cover part of the end faces of the coil former.

BRIEF DESCRIPTION OF THE DRAWINGS

The invention and further advantageous refinements of the invention as well as further advantages are to be explained and described in more detail with reference to the drawing, in which several exemplary embodiments of the invention are represented and in which.

Figure 1:
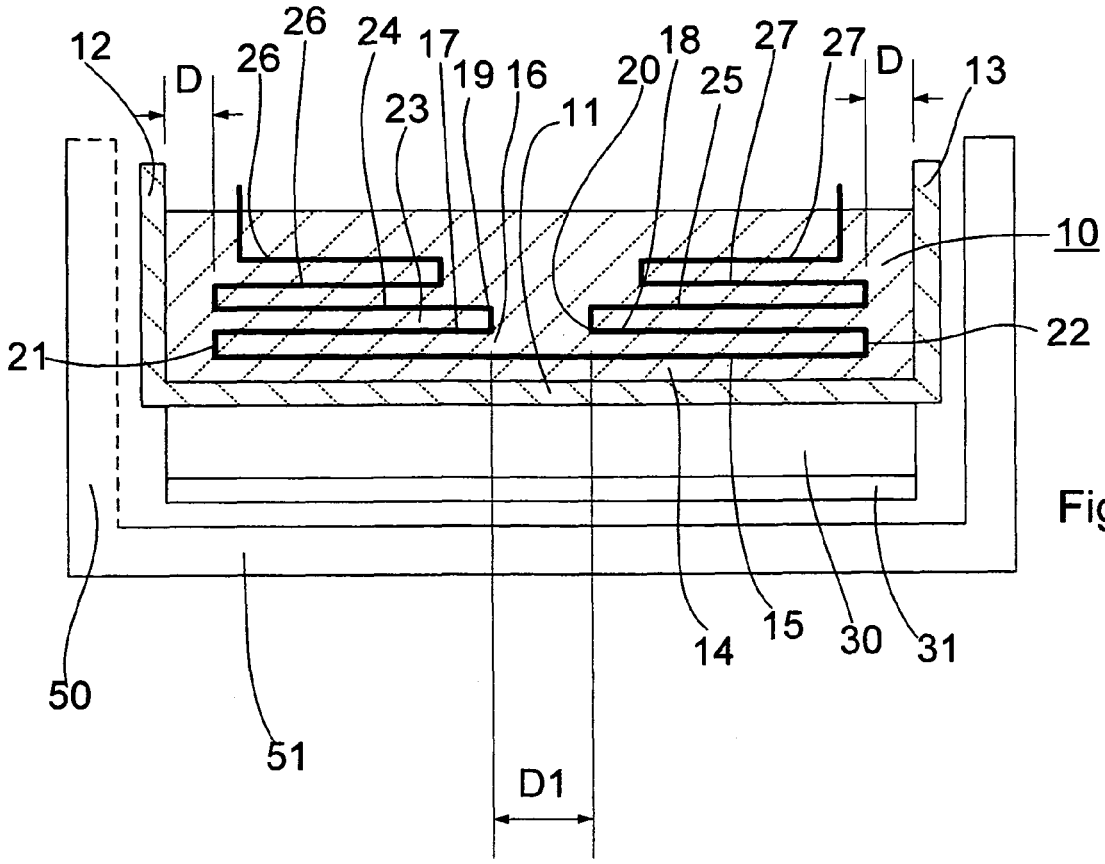
FIG. 1 shows a longitudinal sectional view of a first refinement of a coil according to the invention.

Reference is now made to FIG. 1.

DETAILED DESCRIPTION

Figure 4:
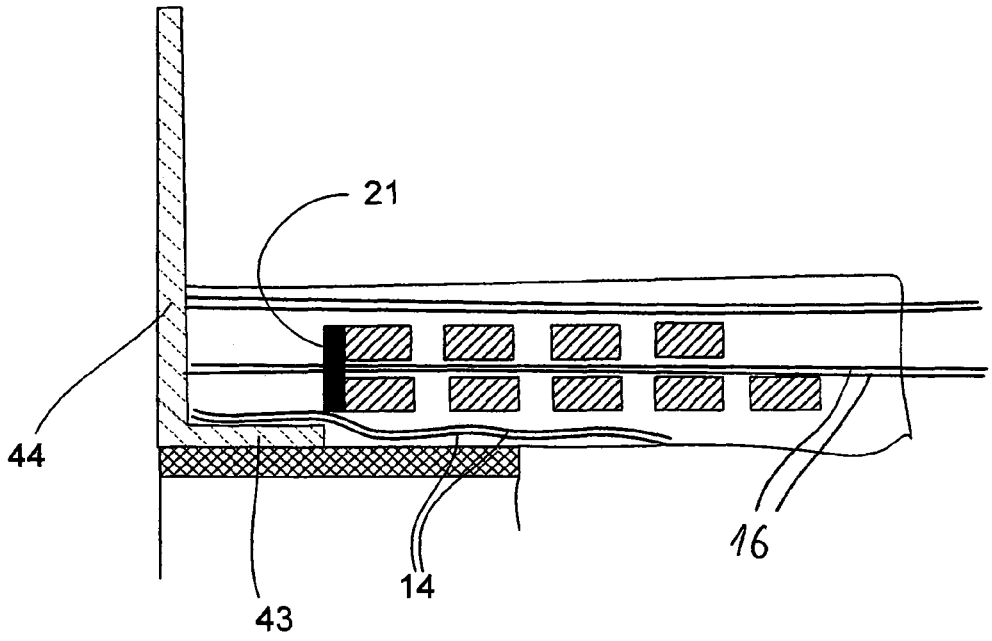
FIG. 4 shows an enlarged detail according to "A" of FIG. 3.

A coil former 10, which is produced by the method according to the invention, surrounds a coil tube 11, to the ends of which radially outwardly adjoining, flange-like end wall sections 12, 13 are attached, here in the first exemplary embodiment are integrally formed on. A first insulating layer 14 is applied, preferably wound, onto the coil tube 11 between the end wall sections 12, 13. Like all the other insulating layers (see below), this insulating layer 14 may comprise a woven fabric which is impregnated with curable resin. The insulating layer 14 extends as far as the end wall sections 12, 13. Wound onto this insulating layer is a first winding layer 15, which in FIG. 1 (and in FIG. 2) is drawn as a line. As revealed by FIG. 4, a rectangular winding wire may be used. Instead of a winding wire of a rectangular form, one with a circular cross section could also be used. The cross-sectional shape is not of any significance to this extent for the invention. The winding wire layer 15 ends at a certain distance D from the end wall sections 12, 13.

A second insulating layer 16 is applied, i.e. wound, onto the first winding or wire layer 15, to be precise again as far as the end wall sections 12, 13. Two winding layer sections 17, 18 are wound onto this second insulating layer 16, their opposite ends lie in the radial plane in which the ends of the first winding layer 15 lie and their mutually opposing ends 19, 20 are arranged at a distance D1 from one another. As can be seen from FIG. 4, the winding layers 15, 17 and 18 are connected to one another by radially extending connecting elements 21, 22, these connecting elements 21, 22 lying in the planes in which the ends of the first winding layer 15 lie.

A third insulating layer 23 is wound onto the second winding sections 17, 18, two third winding sections 24, 25, the lengths of which are the same as the second winding sections 17, 18, are wound onto the latter and are connected to them at their opposite ends by means of radial connecting elements similar to those with the designations 21, 22, after which a fourth insulating layer (undesignated) is applied and then two fourth winding sections 26, 27, a further insulating layer and then two fifth winding sections 26, 27, and then the outer insulating layer. The third winding sections 24, 25 are connected to the fourth winding sections 26, 27 by connecting elements in the radial plane of the ends of the first winding layer 15 and the fourth winding sections are connected to the fifth winding sections at the ends facing one another, the length of the fourth and fifth winding sections being less than the length of the second and third winding sections 17, 24; 18, 25.

Spacers 30 are arranged inside the coil tube 11, evenly distributed around the circumference. Lying inside the spacers 30 are secondary windings 31, which are only schematically indicated here. The space between the spacers 30, which are radially aligned and extend over the entire length of the coil tube 11, is flowed through axially by a cooling fluid. The assignment of the secondary windings 31 and the spacers to the coil tube 11 is not of significance for the invention.

Figure 3:
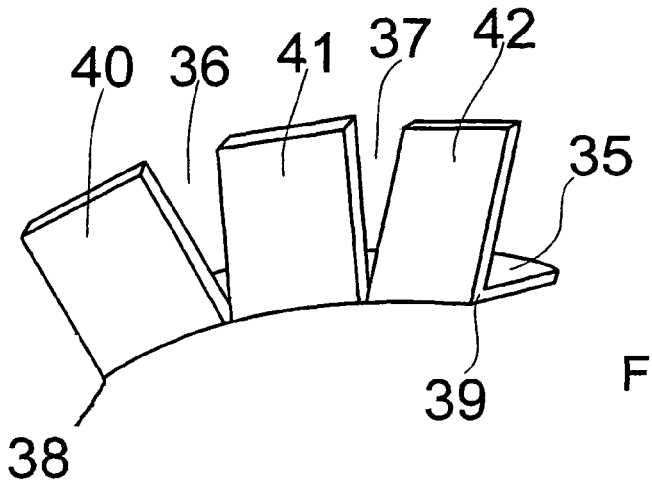
FIG. 3 shows a refinement of an angle piece for the second embodiment, in a perspective representation.

In the case of the second refinement, the end wall sections are formed by angle pieces, which are perspectively represented in FIG. 3. Slits 36, 37 are provided at one end of an arcuate piece 35, which is adapted to the coil tube 11. The lugs 40, 41 and 42 forming between the peripheral ends 38, 39 and the slits 36, 37 are bent up radially outward, so that the slits 36, 37 become V-shaped. The arcuate piece 35 forms the leg 43 of the angle piece, which in FIG. 4 has been given the overall designation 44. The axially extending leg 43 is wound with the first insulating layer 14 into the coil former. The entire coil former requires as many angle pieces (which are represented in FIG. 3) as it takes for the angle pieces that are shown in FIG. 3 to cover the entire circumference of the coil tube. After the curing of the insulating material, the angle pieces can be removed. The openings thereby obtained can remain free or be closed with insulating material.

Figure 2:
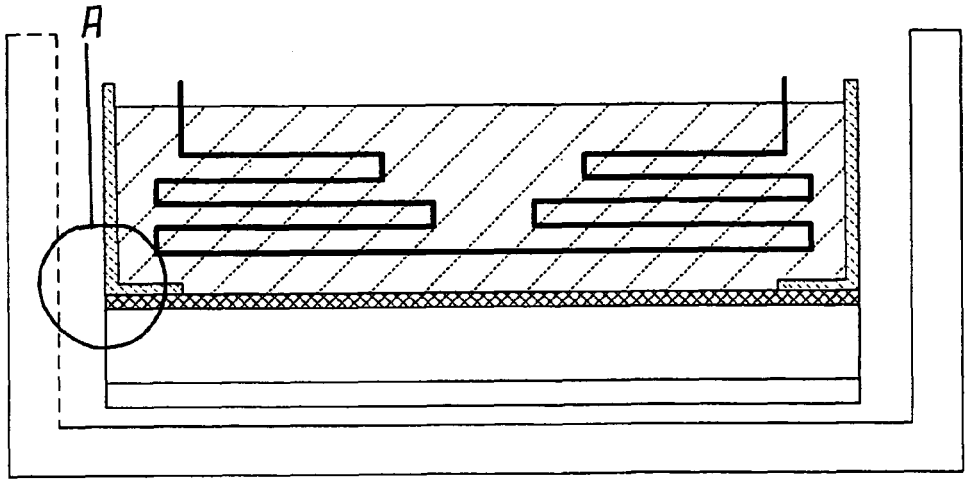
FIG. 2 shows a longitudinal sectional view similar to that of FIG. 1 of a second refinement of a coil according to the invention.

In the embodiment that is shown in FIG. 2, angle pieces of which the radially aligned legs cover the entire end faces of the coil former are provided. It goes without saying that there is also the possibility of setting a number of angle pieces radially one over the other at the end faces or ends of the coil former, the arcuate pieces 35 being adapted to the further outwardly lying radius, for example in the region of the third winding sections. The lugs have a radial length that is adapted to the fitting location on the coil former, the lugs of all the angle pieces each lying in a radial plane corresponding here to the end planes of the coil former. The legs 43 of the outer angle pieces are then enclosed by the corresponding insulating layers.

To complete a transformer, cores 50 are provided, represented by dashed lines and engaging with a leg 51 in the region inside the secondary winding 31. However, this has nothing to do with the invention described here, but serves merely for better understanding.

The invention claimed is:

1. A method for winding a coil for a transformer comprising:

providing a cylindrical inner tube of insulating material including a radially outwardly projected first end wall section disposed at a first end of the cylindrical inner tube and a radially outwardly projecting second wall section disposed at a second end of the cylindrical inner tube;

winding a first insulating layer onto the cylindrical inner tube so as to extend to the first end wall section and the second end wall section;

winding a first winding wire layer onto the first insulating layer so as to provide a first distance between a first end of the first winding wire layer and the first wall section and a second distance between a second end of the first winding layer and the second end wall section;

winding a second insulating layer onto the first winding layer, the second insulating layer extending to the first end wall section and the second end wall section;

winding a second winding wire layer including at least one winding layer section onto the second insulating layer, wherein the at least one winding layer section of the second winding wire layer includes a first end and a second end, and wherein the first end of the at least one winding layer section of the second winding wire layer shares a radial plane with one of the first and the second end of the first winding wire layer;

connecting one of the first and the second end of the first winding wire layer and the first end of the at least one winding layer section of the second winding wire layer using a first radially extending connecting element;

winding a third insulating layer onto the second winding layer, the third insulating layer extending to the first end wall section and the second end wall section;

winding a third winding wire layer including at least one winding layer section onto the third insulating layer, wherein the at least one winding layer section of the third winding wire layer includes a first end and a second end, and wherein the second end of the at least one winding layer section of the third winding wire layer and the second end of the at least one winding layer section of the second winding wire layer share a radial plane;

connecting the second end of the at least one winding layer section of the third winding wire layer and the second end of the at least one winding layer section of the second winding wire layer using a second radially extending connecting element;

winding a fourth insulating layer onto the third winding layer, the fourth insulating layer extending to the first end wall section and the second end wall section;

winding a fourth winding wire layer including at least one winding layer section onto the fourth insulating layer, wherein the at least one winding layer section of the fourth winding wire layer includes a first end and a second end, and wherein the first end of the at least one winding layer section of the fourth winding wire layer and the first end of the at least one winding layer section of the third winding wire layer share a radial plane; and connecting the first end of the at least one winding layer section of the fourth winding wire layer and the first end of the at least one winding layer section of the third winding wire layer using a third radially extending connecting element.

2. The method as recited in claim 1, further comprising winding a fifth insulating layer onto the fourth winding layer, the fifth insulating layer extending to the first end wall section and the second end wall section;

winding a fifth winding wire layer including at least one winding layer section onto the fifth insulating layer, wherein the at least one winding layer section of the fifth winding wire layer includes a first end and a second end, and wherein the second end of the at least one winding layer section of the fifth winding wire layer and the second end of the at least one winding layer section of the fourth winding wire layer share a radial plane; and connecting the second end of the at least one winding layer section of the fifth winding wire layer and the second end of the at least one winding layer section of the fourth winding wire layer using a fourth radially extending connecting element.

3. The method as recited in claim 1, further comprising curing the insulating material, and removing the first end wall section and the second end wall section so as to provide a first and a second opening.

4. The method as recited in claim 3, further comprising closing the first and the second openings with insulating material.

5. A coil for a transformer comprising:

a cylindrical inner tube of insulating material including a radially outwardly projected first end wall section disposed at a first end of the cylindrical inner tube and a radially outwardly projecting second wall section disposed at a second end of the cylindrical inner tube;

a first insulating layer wound onto the cylindrical inner tube so as to extend to the first end wall section and the second end wall section;

a first winding wire layer wound onto the first insulating layer so as to provide a first distance between a first end of the first winding wire layer and the first wall section and a second distance between a second end of the first winding layer and the second end wall section;

a second insulating layer wound onto the first winding layer, the second insulating layer extending to the first end wall section and the second end wall section;

a second winding wire layer including at least one winding layer section wound onto the second insulating layer, wherein the at least one winding layer section of the second winding wire layer includes a first end and a second end, and wherein the first end of the at least one winding layer section of the second winding wire layer shares a radial plane with one of the first and the second end of the first winding wire layer;

a first radially extending connecting element connecting one of the first and the second end of the first winding wire layer and a first end of the at least one winding layer section of the second winding wire layer;

a third insulating layer wound onto the second winding layer, the third insulating layer extending to the first end wall section and the second end wall section;

a third winding wire layer including at least one winding layer section wound onto the third insulating layer, wherein the at least one winding layer section of the third winding wire layer includes a first end and a second end, and wherein the second end of the at least one winding layer section of the third winding wire layer and the second end of the at least one winding layer section of the second winding wire layer share a radial plane;

a second radially extending connecting element connecting the second end of the at least one winding layer section of the third winding wire layer and, the second end of the at least one winding layer section of the second winding wire layer;

a fourth insulating layer wound onto the third winding layer, the fourth insulating layer extending to the first end wall section and the second end wall section;

a fourth winding wire layer including at least one winding layer section wound onto the fourth insulating layer, wherein the at least one winding layer section of the fourth winding wire layer includes a first end and a second end, and wherein the first end of the at least one winding layer section of the fourth winding wire layer and the first end of the at least one winding layer section of the third winding wire layer share a radial plane; and a third radially extending connecting element connecting the first end of the at least one winding layer section of the fourth winding wire layer and the first end of the at least one winding layer section of the third winding wire layer.

6. The coil as recited in claim 5, further comprising a fifth insulating layer wound onto the fourth winding layer, the fifth insulating layer extending to the first end wall section and the second end wall section;

a fifth winding wire layer including at least one winding layer section wound onto the fifth insulating layer, wherein the at least one winding layer section of the fifth winding wire layer includes a first end and a second end, and wherein the second end of the at least one winding layer section of the fifth winding wire layer and the second end of the at least one winding layer section of the fourth winding wire layer share a radial plane; and a fourth radially extending connecting element connecting the second end of the at least one winding layer section of the fifth winding wire layer and the second end of the at least one winding layer section of the fourth winding wire layer.

7. The coil as recited in claim 5, wherein the first and the second end wall sections are connected to an insulating tube, the insulating tube surrounded by a coil former.

8. The coil as recited in claim 5, wherein the first and the second end wall sections include a first and a second L-shaped angle element having a first and a second leg respectively extending perpendicularly to one another, and wherein one of the first and the second leg is parallel to the winding wire layers and one of the first and the second leg forms the first or the second end wall section.

9. The coil as recited in claim 8, wherein the first and the second angle elements provide a dedicated end wall section for at least one insulating layer.

10. The coil as recited in claim 8, wherein the first and the second angle elements are arcuately formed, and wherein one of the first and the second leg form an arcuate shape and one of the first and the second leg bend out perpendicularly as a lug.

11. The coil as recited in claim 10, wherein the lugs are disposed between axial slits formed by a piece of bent tubing, the lugs being bent out perpendicularly.

* * * * *